US006431149B1

(12) United States Patent
Schwegler et al.

(10) Patent No.: US 6,431,149 B1
(45) Date of Patent: Aug. 13, 2002

(54) FUEL SUPPLY SYSTEM OF AN INTERNAL COMBUSTION ENGINE

(75) Inventors: Helmut Schwegler, Pleidelscheim; Martin Maier, Möglingen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/622,875

(22) PCT Filed: Nov. 23, 1998

(86) PCT No.: PCT/DE98/03441

§ 371 (c)(1),
(2), (4) Date: Nov. 9, 2000

(87) PCT Pub. No.: WO99/43953

PCT Pub. Date: Sep. 2, 1999

(30) Foreign Application Priority Data

Feb. 24, 1998 (DE) ..... 198 07 702

(51) Int. Cl.[7] ..... F02M 37/04
(52) U.S. Cl. ..... 123/467; 123/456
(58) Field of Search ..... 123/456, 467, 123/468, 469

(56) References Cited

U.S. PATENT DOCUMENTS 5,056,489 A 10/1991 Lorraine
5,398,655 A 3/1995 Tuckey
5,577,478 A 11/1996 Tuckey
5,579,739 A 12/1996 Tuckey et al.
5,845,621 A * 12/1998 Robinson et al. ..... 123/456
5,896,843 A * 4/1999 Lorraine ..... 123/467
6,148,798 A * 11/2000 Braun et al. ..... 123/467

FOREIGN PATENT DOCUMENTS

DE 34 32 727 11/1985
DE 41 31 952 4/1992
DE 43 41 368 6/1995

* cited by examiner

*Primary Examiner*—Thomas N. Moulis
(74) *Attorney, Agent, or Firm*—Kenyon & Kenyon

(57) ABSTRACT

A fuel supply system of an internal combustion engine that has fuel injection is described. The fuel supply system has a fuel rail, from which injectors are supplied with fuel via valve seats. The damper element has an elastic tubular body arranged in the fuel rail. The tubular body sealingly separating an inner fuel chamber, through which fuel flows, from an outer fuel chamber, through which fuel flows and which is connected to the valve seats. Walls of the tubular body are made of an elastic material. The elastic tubular body is arranged upstream of a pressure regulator.

6 Claims, 1 Drawing Sheet

FUEL SUPPLY SYSTEM OF AN INTERNAL COMBUSTION ENGINE

FIELD OF THE INVENTION

The present invention relates to a fuel supply system of an internal combustion engine.

BACKGROUND INFORMATION

German Patent No. 41 31 952 describes a fuel supply system that has a fuel rail with a plurality of valve seats for injectors. The fuel rail, in this context, has a tubular base body, in whose interior a further tubular body is mounted. The fuel rail also contains a pressure regulator for maintaining a constant pressure in the fuel supply line of the tubular base body. The interior tubular body is made of elastically malleable material, so that it permits a modification of volume and/or form of the fuel supply line, if the pressure in it suddenly changes. The pressure regulator, in this context, is arranged on the fuel rail such that it is located downstream of the fuel supply line. To this extent, the interior tubular body, arranged for its part downstream of the pressure regulator, represents a return line. Therefore, the fuel supply system is operated in a manner such that fuel is supplied under pressure via a fuel connector to the fuel supply line in the outer tubular base body, from where it can reach the injectors. If the pressure in the fuel supply line exceeds a predetermined value, it acts upon the pressure regulator, in which a blocking element opens, as a result fuel flows into the interior tubular body functioning as a return line. The interior tubular body in principle only has fuel flowing through it if the fuel regulator has opened. Therefore, a design of this type is not suitable for fuel supply systems that do not have a return line.

German Patent No. 34 32 727 describes fuel supply lines for fuel injection systems of internal combustion engines. These fuel supply lines have one rigid wall part and at least one elastic wall part, connected to the former, so that the fuel pressure fluctuations, arising in response to the process of injecting fuel into the combustion chamber, are damped in the fuel supply line. The elastic wall part has considerable areas that must be outwardly sealed. This represents a safety risk for the operation of the internal combustion engine and for the environment. In addition, the elastic wall must be designed so as to be sufficiently rigid and fixed so that a tight seal for the system can be assured, which is achieved at the expense of the desired damping effect.

German Patent No. 43 41 368 describes a damper element for damping pressure fluctuations in the fuel supply system of an internal combustion engine. The system provides a damper element located in the fuel rail. The damper element is composed of one or more gas-filled chambers, whose walls are made of an elastic material. These chambers are arranged in the vicinity of the injectors, so as to achieve, in the process, the greatest damping effect on the pressure fluctuations originating from the injectors. In order to prevent clogging of the injectors, spacers must additionally be provided to assure, at every time point, a predetermined distance of the chambers from the valve seat feed pipes. However, in spite of the saving of space due to the damper element being housed in the fuel rail, this arrangement is expensive.

To operate fuel rail systems, it is usually necessary to use pressure regulators that reduce a higher intake pressure to a lower system pressure prevailing in the fuel rail. The design of pressure reducers of this type is conventional. Pressure reducers, in particular in fuel supply systems not having a return line, are arranged upstream and outside of the fuel rail. The control diaphragm is arranged on the system-pressure side and, at the same time, takes on a damping function. Thus, U.S. Pat. No. 5,398,655 describes a fuel regulating device for a fuel rail system that does not have a return line. The device has a pressure reducing valve arranged so as to be separate from the fuel rail. The valve either opens or closes as a function of the demand for fuel in the fuel rail system and, in this context, maintains an essentially constant pressure potential for the injectors. However, due to the additional devices, this system represents a safety risk, since, in response to damage that can occur, for example, in accidents, additional shortcomings in the tightness of the seal can arise.

For systems having return lines, conventional pressure regulating valves are used, usually arranged outside of the fuel rail tube. In these pressure-limiting valves, the diaphragm is positioned on the intake side. Since the return lines used are arranged in the fuel rail tube and are metallic and rigid, separate pressure dampers must be used in the return line, to avoid negatively impacting the system as a result of the pressure fluctuations arising therein.

SUMMARY

A fuel supply system according to the present invention has the advantage that a damper element is arranged in the fuel rail itself, which makes possible, in particular, a simple design having the low associated manufacturing costs. On the basis of the arrangement according to the present invention, no further space is needed in the internal combustion engine or in the engine compartment. Further, the damping of the pressure fluctuations in the fuel supply of the rail system, brought about by the switching pulses of the injectors, is in the immediate vicinity of the point origin, i.e., of each injector, it being possible to avoid a reciprocal influencing of the quantity of fuel to be injected. Since the damper element is arranged internally, i.e., in the fuel rail itself, no additional seals need to be provided to the outside, thus reducing the danger of damage and the endangerment of the environment that is associated therewith.

In addition, the arrangement of the damper element, according to the present invention, is advantageous because it is positioned close to all existing injectors, and it can effectively counteract the fluctuations at their point of origin without, in the process, bringing about the danger of the damper element clogging the injectors. The arrangement of specific spacers is not required.

According to the present invention the pressure regulator, usually a pressure reducing valve is configured, so as to be integrated in the fuel rail. As a result, a simple, elastic tubular body, for example, a rubber tubing that is resistant to organic solvents, can be used as the damper element. The tubular body, arranged in the rail tube, permanently damps the fluctuations on the intake side. As a result of the arrangement of the damper element in the fuel rail itself, for example coaxially in regard to it, there is no direct contact of the damper element with the ambient environment, so that the danger of an outflow of fuel into the ambient environment is reduced.

A further advantage of this arrangement can be seen in the fact that the elastic tubular body arranged in the fuel rail not only permanently damps the fluctuations brought about by the operation of the injectors on the system side, i.e., in the fuel chamber of the rail that is external with regard to the tubular body, but the tubular body, on the intake side, can also take on damping functions with regard to pressure fluctuations brought about by the fuel-supply pump, because the inflow into the rail proceeds via the inner fuel chamber of the tubular body.

BRIEF DESCRIPTION OF THE DRAWING

The FIGURE shows a cutaway view of a fuel rail having a damper element.

DETAILED DESCRIPTION

Figure 1:
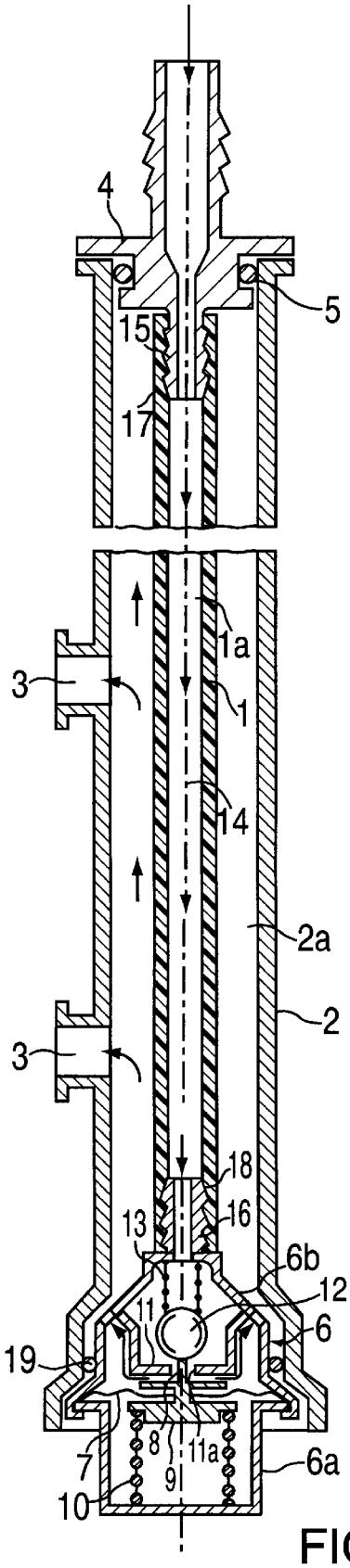

A damper element 1 is proposed for damping system-side and intake-side pressure fluctuations in a fuel supply system, for example in a fuel rail 2 of internal combustion engines having fuel injection using injectors (not depicted). Damper element 1 is designed, for example, in the form of an elastic tubular body.

In the FIGURE, a fuel rail 2 for an internal combustion engine is depicted. Fuel rail 2, in which valve seats 3 are located for mounting injectors (not depicted), has an elongated form and functions to distribute fuel to a plurality of injectors. As a fuel rail, any conventional rail can be used, for example as described in U.S. Pat. No. 5,577,478 and U.S. Pat. No. 5,056,489. At the upstream end of the fuel rail, a connecting piece 4 is located for sealingly mounting a supply line on fuel rail 2. Connecting piece 4 can be sealed off, for example, by an O-ring as a gasket seal 5 made of a material that is resistant to the fuel. It also is possible to use other conventional measures for a sealing connection, for example, clamps, etc. Connecting piece 4 can be mounted on tubular fuel rail 2 in any conventional manner of one skilled in the art, for example, using bolts, clamps, inter alia. Connecting piece 4 is configured on the side facing fuel rail 2 such that elastic tubular body 1 can be mounted on it in a sealing connection. The connecting piece 4 has, for example, a short feed pipe 15 that has projections, e.g., in the form of ribs 17 on its surface. The short feed pipe is provided in connecting piece 4 and has a diameter corresponding to elastic tubular body 1, which can be mounted in a frictionally engaged manner on the connecting piece. Clamps and other means to achieve a solid and sealing connection of tubular body 1 can also be used.

Elastic tubular body 1 extends coaxially with respect to a longitudinal axis 14 over the entire length of fuel rail 2 and is sealingly joined, at the end downstream from connecting piece 4, to a pressure regulator 6. As a result of this arrangement, an inner fuel chamber 1*a*, located in the tubular body, is separated from an outer fuel chamber 2*a* of fuel rail 2. The outer fuel chamber also is designated as the system side, from which fuel arrives in the combustion chamber of the internal combustion engine via the injectors. The connection of elastic tubular body 1 to pressure regulator 6 can be made in any conventional manner, for example, through a short feed pipe 16 that has ribs 18, as is described with regard to connecting piece 4 of the supply line.

Pressure regulator 6 is subdivided, for example, into two housing parts 6*a* and 6*b*, which are separated from each other by a diaphragm 7. In diaphragm 7, a rigid piston 9 furnished with a guide pin 8 is provided. The piston is pre-stressed by a spring 10 provided in housing part 6*a*. Piston 9, connected to diaphragm 7, together with guide pin 8, is pressed by the force supplied by spring 10 onto a contact surface 11 arranged in housing part 6*b*. An opening 11*a* for the accommodating and guiding of pin 8 is located in the contact surface. Contact surface 11 is sealingly connected at its edges to housing part 6*b*, so that opening 11*a* represents the only entrance to outer fuel chamber 2*a* of the system side. On the upstream side of contact surface 11, a sphere 12 is located that is made of a rigid material. The sphere is pre-stressed by a spring 13 against pin 8 protruding from opening 11*a* of contact surface 11. Means are provided for guiding sphere 12, so that the latter, in accordance with the pressure, can move from the system or intake side towards opening 11*a* or away from it, respectively. In this context, the prestressing of springs 10 and 13 is selected such that, in the resting state, piston 9 is pressed by the pressure of spring 10 onto contact surface 11, the inflow of fuel into outer fuel chamber 2*a* through opening 11*a* being prevented. If, as a result of the inflow of fuel through inner fuel chamber 1*a* of elastic tubular body 1, the pressure on the upstream side of pressure regulator 6 increases, then the sphere arranged in front of contact surface 11 presses on pin 8 and moves piston 9, sealingly closed in the resting position. In the downstream direction, an intermediate space is formed between piston 9 and contact surface 11, and fuel is able to pass through the intermediate space into outer fuel chamber 2*a* of fuel rail 2. When a predetermined system pressure is reached, pressure regulator 6 closes once again and opens next in response to an undershooting of the system pressure.

Other conventional pressure regulators can also be used, such as those described, for example, in U.S. Pat. No. 5,577,478, U.S. Pat. No. 5,579,739, and U.S. Pat. No. 5,398,655.

Pressure regulator 6 is sealingly mounted on fuel rail 2, for example using a gasket seal 19.

The fuel that arrives in fuel chamber 2*a* via pressure regulator 6, in response to a reduced pressure, is distributed within it and is injected by injectors mounted on valve seats 3 into the combustion chambers of the internal combustion engine.

The pressure fluctuations generated by the injection processes in outer combustion chamber 2*a* of rail 2 are effectively equalized by elastic tubular body 1 arranged in fuel rail 2 and in the vicinity of valve seats 3. In this context, it is advantageous that elastic tubular body 1 extend over the entire length of fuel rail 2, for example coaxially in relation to it, and therefore, as a result of the design according to the present invention, the tubular body is arranged in the vicinity of each injector. The pressure fluctuations transmitted to elastic tubular body 1 are, in turn, transferred in tubular body 1 to the fuel flowing under intake pressure in inner fuel chamber 1*a*, the fluctuations being absorbed in elastic tubular body 1. The fluctuations generated by the opening and closing motion of pressure regulator 6 are also damped.

By damping the pressure fluctuations in outer fuel chamber 2*a*, along with their associated negative impact on the injection quantities in the specific injectors, not only are the pressure fluctuations in outer fuel chamber 2*a* removed, but also the noise emissions associated therewith.

What is claimed is:

1. A fuel supply system of a fuel-injection internal combustion engine, comprising:

a fuel rail for supplying injectors with fuel via valve seats;

a damper element arranged in the fuel rail, the damper element having a tubular body and damping pressure fluctuations, a wall of the tubular body being made of an elastic material, the tubular body sealingly separating an inner fuel chamber from an outer fuel chamber, fuel flowing through the inner fuel chamber and the outer fuel chamber, the inner fuel chamber being part of a supply line segment, the outer fuel chamber being connected to the valve seats; and a pressure regulator arranged at a downstream end of the supply line segment, the fuel only subsequently arriving in the outer fuel chamber via the pressure regulator.

2. The fuel supply system according to claim 1, wherein:

the pressure regulator is a pressure reducing valve, the pressure reducing valve setting a constant fuel pressure in the outer fuel chamber.

3. The fuel supply system according to claim 1, wherein:

the pressure regulator is integrated in the fuel rail.

4. The fuel supply system according to claim 1, wherein:

the elastic tubular body is made of at least one of a rubber, a plastic and an elastic, liquid-tight web.

5. The fuel supply system according to claim 1, further comprising:

an intake feed pipe and an outlet feed pipe arranged at the fuel rail, the feed pipes having ribs and housing the elastic tubular body.

6. The fuel supply system according to claim 1, wherein:

the fuel rail does not have a return line.

* * * * *